US009500439B1

(12) United States Patent
Dietrich et al.

(10) Patent No.: US 9,500,439 B1
(45) Date of Patent: Nov. 22, 2016

(54) DEVICE FOR ASSISTING WITH MOVEMENT OF A PISTOL SLIDE

(71) Applicants: Martin Wayne Dietrich, Otis, ME (US); Robin Nathaniel Dietrich, Otis, ME (US)

(72) Inventors: Martin Wayne Dietrich, Otis, ME (US); Robin Nathaniel Dietrich, Otis, ME (US)

( * ) Notice: Subject to any disclaimer, the term of this patent is extended or adjusted under 35 U.S.C. 154(b) by 0 days.

(21) Appl. No.: 14/925,185

(22) Filed: Oct. 28, 2015

(51) Int. Cl.

| | |
|---|---|
| ***F41A 9/53*** | (2006.01) |
| ***F41C 27/00*** | (2006.01) |
| ***F41C 3/00*** | (2006.01) |
| ***F41A 7/00*** | (2006.01) |
| ***F41A 3/72*** | (2006.01) |

(52) U.S. Cl.
CPC ..... *F41C 27/00* (2013.01); *F41A 3/72* (2013.01); *F41A 7/00* (2013.01); *F41C 3/00* (2013.01)

(58) Field of Classification Search
CPC ..... F41C 27/00; F41C 3/00; F41C 33/0281; F41A 3/72
USPC ..... 42/1.01
See application file for complete search history.

(56) References Cited

U.S. PATENT DOCUMENTS 885,436 A * 4/1908 Clement ..... F41A 19/45 42/7
1,680,186 A * 8/1928 Von Frommer ..... F41A 3/66 42/106
2,744,448 A * 5/1956 Allen ..... F41A 3/54 42/69.03
4,043,065 A 8/1977 Musgrave
4,138,044 A * 2/1979 Musgrave ..... F41C 33/0218 224/242
4,298,150 A * 11/1981 Seldeen ..... F41C 33/0227 224/238
4,823,671 A * 4/1989 Buryta ..... F41A 3/72 42/106
6,561,073 B1 * 5/2003 Hogmoe ..... F41C 33/0281 89/1.4
8,015,741 B2 * 9/2011 Hooks ..... F41A 17/46 42/70.01
8,191,301 B2 * 6/2012 Hatfield ..... F41A 19/34 42/90
8,312,803 B2 11/2012 Oz
8,438,774 B2 * 5/2013 Sharp ..... F41C 33/0281 42/90
8,468,734 B2 * 6/2013 Meller ..... F41A 3/72 42/71.02
8,549,785 B2 * 10/2013 Sharp ..... F41C 33/0281 42/90
8,887,432 B2 * 11/2014 Oz ..... F41A 35/06 42/71.01
9,121,662 B1 * 9/2015 Love ..... F41C 27/00
9,157,691 B2 * 10/2015 Parnell ..... F41A 7/00
9,194,636 B2 * 11/2015 McAninch ..... F41A 7/00
9,194,654 B1 * 11/2015 Viani ..... F41C 27/00
9,239,207 B2 * 1/2016 Kresser ..... F41A 3/72
9,267,759 B2 * 2/2016 Speroni ..... F41C 27/00
9,291,413 B1 * 3/2016 Viani ..... F41A 3/72
9,297,613 B2 * 3/2016 Maentymaa ..... F41G 1/00
9,328,991 B2 * 5/2016 Gale ..... F41C 27/00
2004/0200109 A1 * 10/2004 Vasquez ..... F41A 19/01 42/1.01
2010/0170923 A1 * 7/2010 Abushaev ..... F41C 33/0281 224/243
2011/0010978 A1 * 1/2011 Hooks ..... F41A 17/46 42/69.01
2011/0088539 A1 * 4/2011 Oz ..... F41A 19/34 89/1.4
2011/0107644 A1 * 5/2011 Faifer ..... F41C 23/04 42/75.02
2011/0154710 A1 * 6/2011 Hatfield ..... F41A 19/34 42/90
2011/0283587 A1 * 11/2011 Sharp ..... F41C 33/0281 42/90

(Continued)

*Primary Examiner* — Michelle R Clement
(74) *Attorney, Agent, or Firm* — Anthony D. Pellegrini

(57) ABSTRACT

A device for use with a pistol having a slide, said device configured to assist with racking the slide by providing a body configured to removably interface with the slide, said body providing improved means for maintaining a grip and providing improved leverage, thereby allowing the slide to be more easily moved in a rearward direction.

20 Claims, 9 Drawing Sheets

(56) References Cited

U.S. PATENT DOCUMENTS

2012/0131829 A1* 5/2012 Fistikchi ..... F41A 3/72 42/1.06
2012/0198744 A1* 8/2012 Meller ..... F41A 3/72 42/90
2013/0081318 A1* 4/2013 Morando ..... F41A 35/00 42/108
2013/0111799 A1* 5/2013 Lee ..... F41G 11/001 42/106
2013/0180152 A1* 7/2013 Speroni ..... F41C 27/00 42/99
2013/0255478 A1 10/2013 McAninch
2013/0327798 A1* 12/2013 Lee ..... F41C 33/008 224/183
2014/0047753 A1* 2/2014 Grossman ..... F41A 3/66 42/72
2014/0298703 A1* 10/2014 Gale ..... F41C 27/00 42/71.02
2015/0121734 A1* 5/2015 Kresser ..... F41C 3/00 42/16
2015/0184959 A1* 7/2015 Parnell ..... F41A 3/72 89/1.4
2015/0354909 A1* 12/2015 Tarantino ..... F41A 3/72 89/1.4
2016/0061562 A1* 3/2016 Braun ..... F41A 3/72 42/111
2016/0102938 A1* 4/2016 Sroufe ..... F41C 3/00 42/16

* cited by examiner

DEVICE FOR ASSISTING WITH MOVEMENT OF A PISTOL SLIDE

BACKGROUND OF THE INVENTION

Technical Field

The present invention relates generally to firearms, and more specifically it relates to a device to assist an individual in moving (or "racking") the slide of a semi-automatic pistol in order to place a single round of ammunition into the firing chamber of the pistol or to remove a single round of ammunition (whether fired or unfired) from the chamber.

Description of Prior Art

The present invention discloses a device to be used with a semi-automatic pistol. A semi-automatic pistol utilizes a magazine which holds multiple rounds of ammunition; once the pistol is loaded with a single round of ammunition being placed into the firing chamber, the trigger can be pulled and the ammunition is fired. The cartridge of the fired round is then automatically extracted and ejected from the firing chamber and the next round of ammunition is loaded from the magazine into the firing chamber, ready to be fired. This cycle continues until the magazine is empty of ammunition.

However, in order to begin this cycle the first round of ammunition must be moved into the firing chamber manually. This is accomplished by the manual movement of the slide of the pistol. The slide of a pistol is a spring-loaded mechanism located on the top of the pistol. It is designed, in part, to remove and eject any ammunition cartridge currently in the firing chamber (whether fired or unfired) and to bring a new ammunition round from the magazine into the firing chamber in anticipation of firing. This is done by a user manually drawing the slide in a rearward direction relative to the frame of the pistol. Once the slide has been moved rearward to a point of mechanical stop, i.e., is "racked", any ammunition cartridge currently in the firing chamber is ejected and a single round of ammunition is moved into the firing chamber from the magazine. The slide is then moved forward relative to the frame of the pistol by the action of the spring mechanism, returning the slide to its original position, with the pistol being ready for firing. The pistol can continue to fire without re-racking the slide until all of the rounds in the magazine have been fired. The slide is also used to clear the firing chamber of ammunition cartridges, for example, where a round of ammunition fails to fire or becomes stuck, whether or not there are ammunition rounds still in the magazine.

The device of the present invention is intended to solve a problem faced by individuals who have difficulty racking the slide of a pistol. Depending on the type of pistol, the amount of force that is required to draw the slide rearward to a sufficient degree to chamber a round of ammunition or to eject an ammunition cartridge can be quite substantial. Together with the fact that the slide typically has few features available onto which a user may get a strong grip, racking a slide can be extremely difficult. Users who have small hands, older users who have lost strength in their grip, arthritis sufferers, disabled persons, and many others may not be able to grip and move the slide of many popular types of pistols without great difficulty.

There have been several attempts to solve the problem of difficulty in racking a slide. For example, a patent issued to Daniel Musgrave, U.S. Pat. No. 4,043,065 ("Pistol Charging Socket"), on Aug. 23, 1977, provides for a holster with a hole. The barrel of the pistol is placed into the holster and through the hole, and then the pistol is forced downward by the user. Since the diameter of the hole is smaller than the width of the slide, the slide is moved rearward relative to the rest of the pistol as the pistol moves downward into the holster. This device, though, requires the holster to be affixed to the user, and during the act of racking the slide the holster tends to move about and the barrel of the pistol may be directed towards the user's leg, raising safety concerns. Also, pistols with full length guide rods cannot be used with this device. A patent issued to Moshe Oz, U.S. Pat. No. 8,312,803 ("Semi Automatic Pistol Slide Pull"), on Nov. 20, 2012, provides for a small plate to be placed onto the rear of the slide. The plate has a pair of lateral flanges and a central aperture. The plate is placed over the rear sight of the pistol, which typically is attached to the slide, with the rear sight extending through the central aperture. To rack the slide the user pulls on one or both of the lateral flanges, drawing the slide rearward. However, as the slide is moved by the plate pushing against the rear sight, this may cause damage to the sight, or misalignment. It is also prone to slipping off the pistol. A patent application filed by Chris McAninch, U.S. application Ser. No. 13/433,837 ("Handgun Charging System"), on Mar. 29, 2012, provides a small body fitted over the front portion of the pistol's barrel and slide. Interior to the body are a pair of channels, one large enough to accommodate the front end of the slide and the other, forward channel large enough to accommodate the barrel but too small to accommodate the end of the slide. The forward surface of the body is then placed against an object, such as a table top or a wall, and the body (and pistol) is pushed against the object. The slide remains stationary within the large channel of the body while the rest of the pistol moves forward, thereby causing a rearward movement of the slide relative to the pistol, thus racking the slide. This device, though, must be used against an object, and cannot be moved by the user's free hand.

The foregoing illustrates that there is a need for a device to assist a user with the movement of a pistol slide that overcomes the shortfalls of the prior art.

It is therefore an object of the present invention to provide a device that can assist a user with the movement of a pistol slide by providing a body that can increase the gripping ability of the user.

It is another object of the present invention to provide a device that can assist a user with the movement of a pistol slide by providing a body that can increase the user's leverage when moving the slide.

It is yet another object of the present invention to provide a device that can assist a user with the movement of a pistol slide by providing a body that can be held in a user's hand while the pistol is held in the user's other hand.

It is yet another object of the present invention to provide a device that can assist a user with the movement of a pistol slide by providing a body that can be placed onto the slide of a pistol without placing stress on the front or rear sights of the pistol.

It is yet another object of the present invention to provide a device that can assist a user with the movement of a pistol slide by providing a body that allows ammunition cartridges to be ejected from the firing chamber during the racking of the slide.

It is yet another object of the present invention to provide a device that can assist a user with the movement of a pistol slide by providing a body that is light weight.

It is yet another object of the present invention to provide a device that can assist a user with the movement of a pistol slide by providing a body that can be inexpensively manufactured.

It is yet another object of the present invention to provide a device that can assist a user with the movement of a pistol slide by providing a body that can be easily and quickly operated by the user in a safe, controlled manner.

Various other objects, features and attendant advantages of the present invention will become obvious to the reader and become fully appreciated as the same becomes better understood when considered in conjunction with the accompanying drawings. It is intended that these objects and advantages are within the scope of the present invention. To the accomplishment of the above and related objects, this invention may be embodied in the form illustrated in the accompanying drawings. Attention being called to the fact, however, that the drawings are illustrative only, and that changes may be made in the specific construction illustrated and described within the scope of this application.

BRIEF SUMMARY OF THE INVENTION

The present invention is a device that is used to assist a user with racking the slide of a pistol. In one embodiment the device provides a rigid elongate body that is placed onto the top of the slide and engages with the front end of the slide. The body is configured to be easy to grip by the user's free hand while the user holds the pistol with the other hand. Because the device is substantially as long as the slide, it provides additional leverage to movement by the user, multiplying the force effect of the user's efforts.

The upper and side portions of the body of the device are configured to allow the user to easily grip the device. The width of the body is such that a human hand easily encircles the top and sides. Alternate configurations include the use of a hand stop on the top surface of the body to give an additional surface for the user's hand to press against, and to prevent slippage of the hand along the body. Other configurations involve one or more grooves formed into the side(s) of the body into which the user's fingers can be placed, allowing for a stronger grip. The underside of the body is configured to allow for a secure interface between the body and the slide while preventing damage to the front and rear sights of the pistol, and to allow for access to the pistol's ejection port so that any ammunition cartridge in the firing chamber can be expelled while the slide is being racked.

The device is used by the user placing the body onto the top of the slide and exerting a downward pressure on the body against the slide, and then moving the body rearward relative to the pistol. As the body moves rearward, it presses against the front of the slide and causes the slide to move with the body relative to the pistol, resulting in the slide being racked. Because the body is easier to grip than the slide, the user has an easier time moving the slide than without use of the device. Once the slide is racked, the device is removed from the pistol and the pistol is ready to be fired.

Other features and advantages of the present invention are described below.

DETAILED DESCRIPTION OF THE INVENTION

Figure 5A:
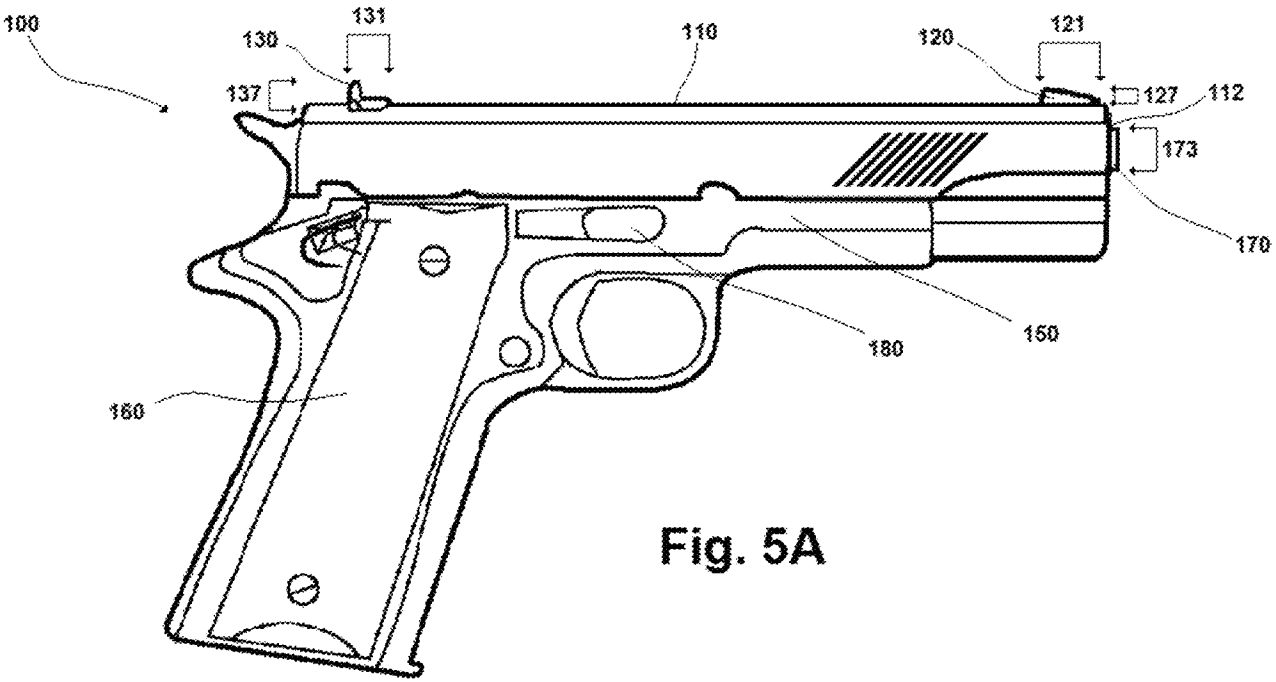
FIG. 5A is a plan side view of a pistol having a slide, suitable for use with the device of the present invention.
Figure 5B:
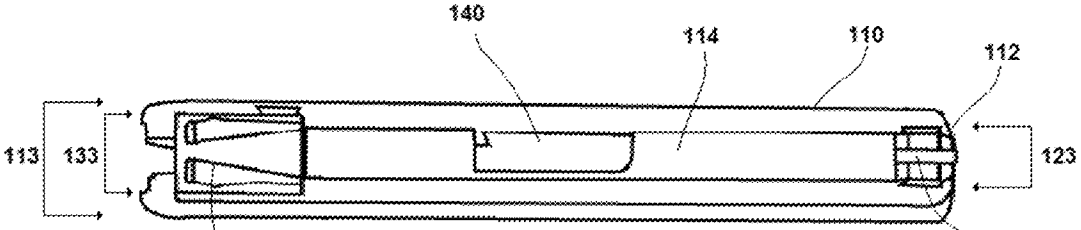
FIG. 5B is a plan top view of the pistol shown in FIG. 5A.

One embodiment of the present invention is a device 1 for assisting with the movement of the slide 110 of a pistol 100. The pistol 100 must be configured to have, in addition to the slide 110, a frame 150, a hand grip 160 integrated with the frame 150, a barrel 170 mounted on the frame 150, a front sight 120 mounted on the slide 110, a rear sight 130 mounted on the slide 110, an ejection port 140 integrated with the slide 110, and an extractor 180. See FIGS. 5A and 5B. These elements are well known in the art and require no further description. The pistol 100 also has a line of fire, being the path of a round fired from the pistol 100 as it exits the barrel 170. The line of fire is located substantially along the longitudinal axis of the barrel 170 of the pistol 100, at least for the initial path of the round. The slide 110 is moveable relative to the frame 150, in forward and rearward directions. The device 1 is configured to assist the user with the movement of the slide 110 in a rearward direction, providing leverage in order to assist with overcoming the resistance inherent in slide mechanisms.

Figure 2:
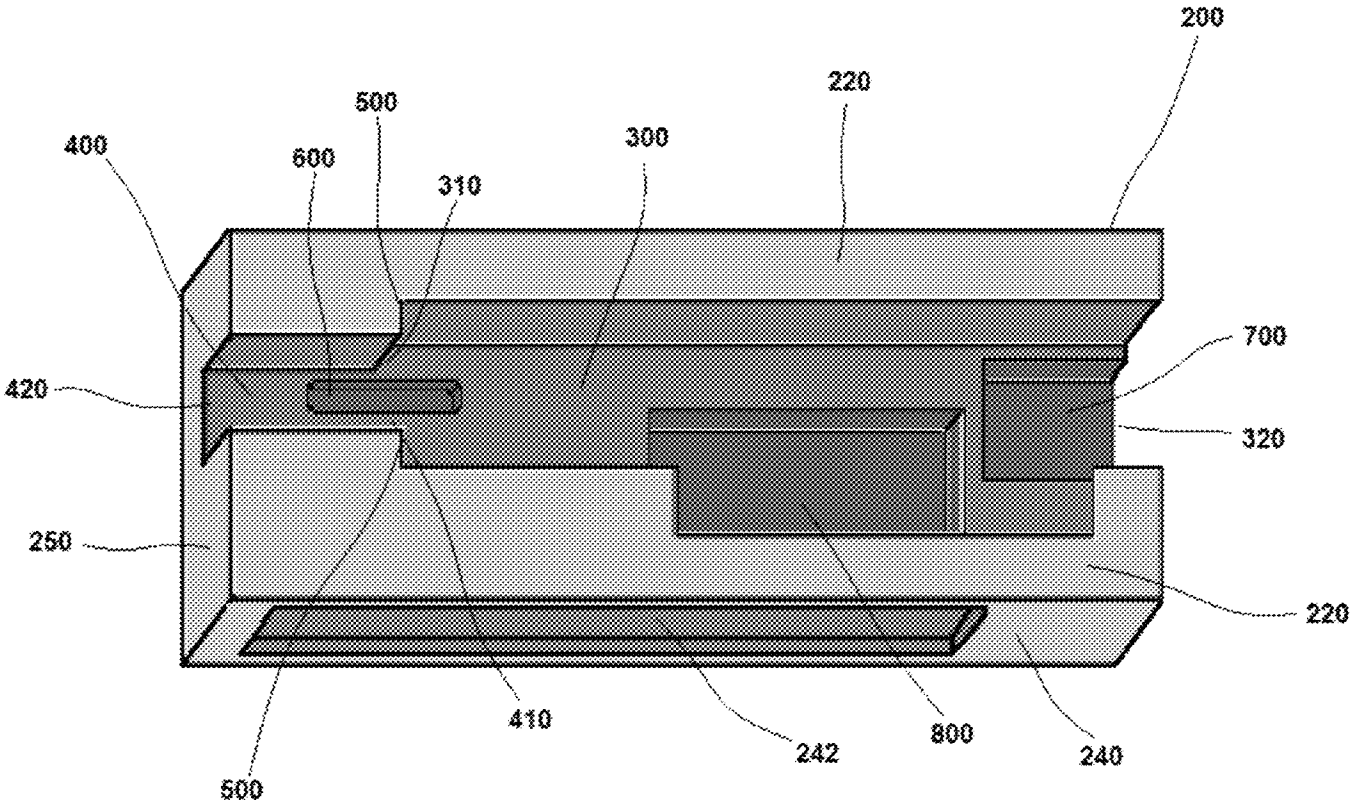
FIG. 2 is a perspective bottom view of the embodiment of the device shown in FIG. 1, also showing the second side wall.
Figure 3:
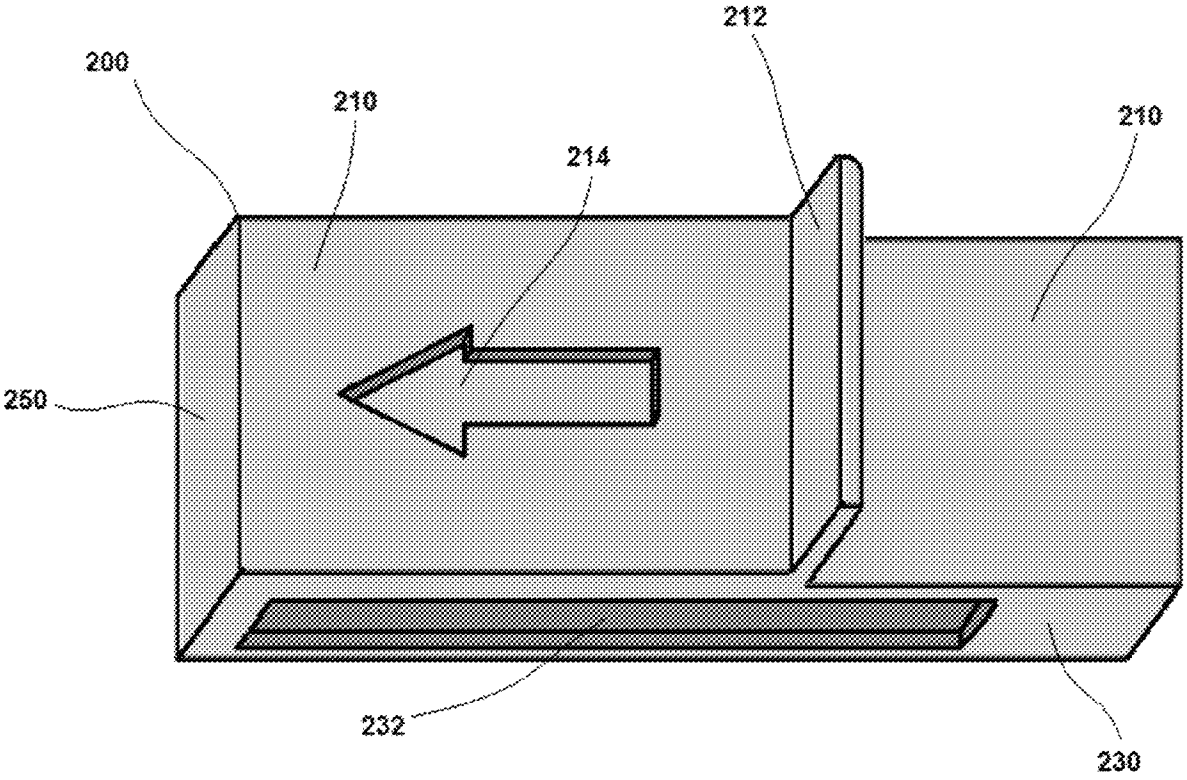
FIG. 3 is a perspective top view of the embodiment of the device shown in FIG. 1, also showing the first side wall.

In one embodiment, the body 200 of the device 1 is monolithic and is constructed of a substantially rigid material. See FIGS. 2 and 3. In the preferred embodiments, the body 200 is constructed of a high impact plastic material. It may be formed by an injection molding process. This results in a structurally sound, durable body 200 that is simple to manufacture. It also results in a body 200 that is light weight, making it easier for a user to manipulate. Other construction materials and processes are also contemplated, however. For example, the body 200 could be carved from a block of wood, or assembled from several separate parts, either made of wood, or plastic, or a metal, or a combination of one or more of the foregoing materials.

The body 200 of the device 1 has a top surface 210, a bottom surface 220, a first sidewall 230, a second sidewall 240, a front face 250, and a rear face 260. See FIGS. 2, 3, 4B, and 4C.

Figure 4A:
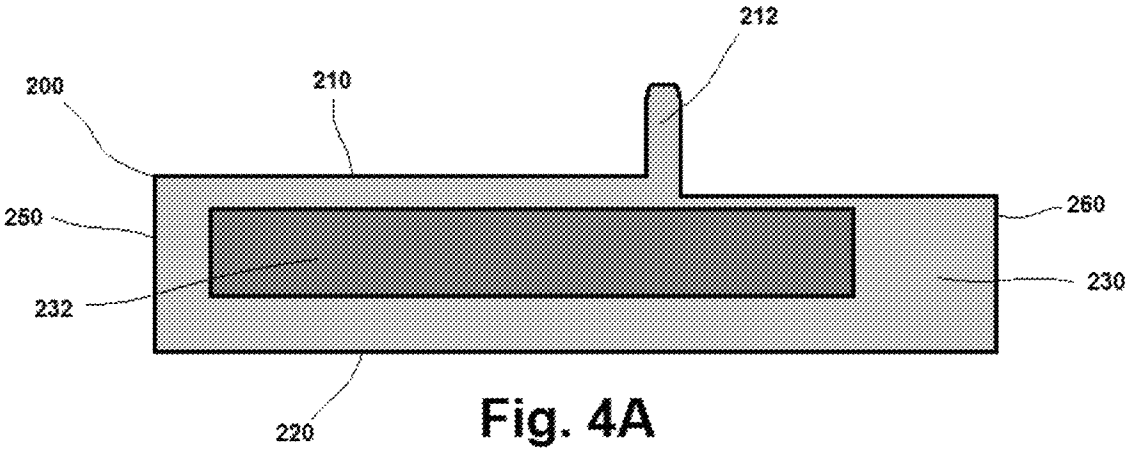
FIG. 4A is a plan side view of the embodiment of the device shown in FIG. 1.
Figure 4B:
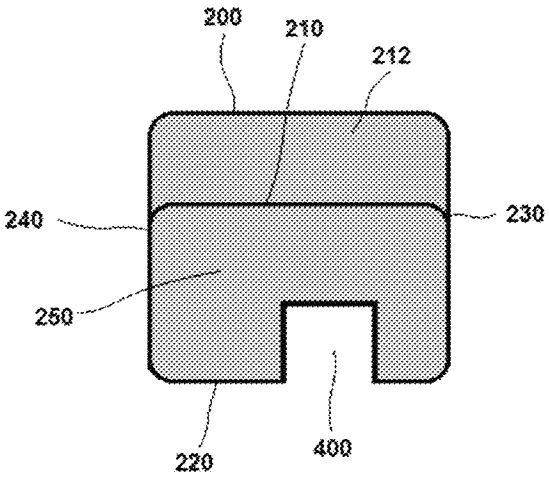
FIG. 4B is a plan front view of the embodiment of the device shown in FIG. 1.
Figure 4C:
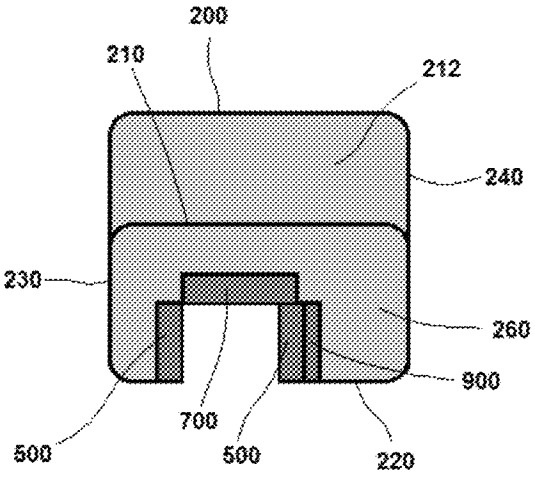
FIG. 4C is a plan rear view of the embodiment of the device shown in FIG. 1.

The top surface 210 of the body 200 should be substantially planar. In one embodiment the top surface 210 is bi-planar, with a forward portion being raised relative to a rear portion, such that the forward portion of the top surface 210 lies in a plane parallel to but above a plane in which the rear portion of the top surface 210 lies. See FIG. 4A.

The first sidewall 230 of the body 200 should be substantially planar, as are the second sidewall 240, the front face 250, and the rear face 260 of the body 200. In the preferred embodiments, the first sidewall 230 is oriented substantially perpendicular to the front 250 and rear faces 260 of the body 200, and the second sidewall 240 is oriented substantially perpendicular to the front 250 and rear faces 260 of the body 200. Both the first 230 and second sidewalls 240 are oriented substantially perpendicular to the top surface 210. The second sidewall 240 is spaced apart from the first sidewall 230 and oriented substantially parallel to the first sidewall 230. The front face 250 of the body 200 is oriented substantially parallel to the rear face 260, and both the front 250 and rear faces 260 are oriented substantially perpendicular to the top surface 210 of the body 200. See FIGS. 4A, 4B, and 4C. Other embodiments of the device 1 contemplate different configurations of the surfaces, sidewalls, and faces, such as slightly flared sidewalls, forming a trapezoidal cross section, or rounded faces, or a convex curved top surface 210, or other configurations, provided the device 1 remains able to be gripped by a human hand.

Figure 1:
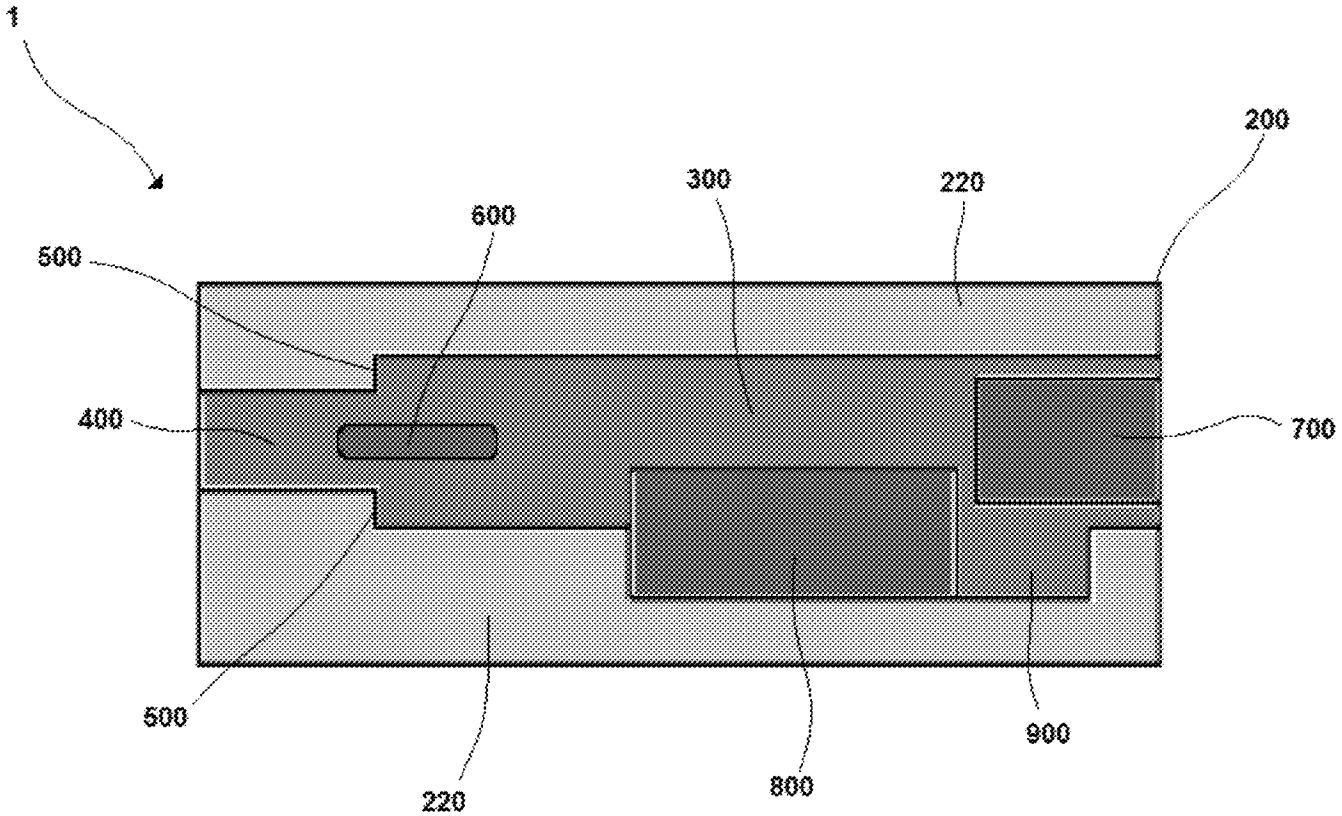
FIG. 1 is a plan bottom view of one embodiment of the device of the present invention.

The bottom surface 220 of the body 200 acts as the interface with the pistol 100. Formed into the bottom surface 220 are a slide channel 300, a barrel channel 400, a slide stop 500, a front sight cutout 600, a rear sight cutout 700, and optionally, an ejection port cutout 800 and an extractor cutout 900. See FIG. 1.

In the preferred embodiments the slide channel 300 is formed into the bottom surface 220 of the body 200 but is not in communication with the top surface 210 of the body 200. In alternative embodiments the slide channel 300 may be in partial communication with the top surface 210, but a substantial portion of the slide channel 300 must be not in communication with the top surface 210 in order to present an interface between the device 1 and the slide 110 of the pistol. The slide channel 300 has a first end 310, a second end 320, and a width, with the first end 310 of the slide channel 300 being in communication with the rear face 260 of the body 200, and the width of the slide channel 300 being slightly greater than the width 113 of the slide 110. See FIG. 2.

In the most preferred embodiments the slide channel 300 extends along the length of the body 200 and is oriented substantially parallel with the longitudinal axis of the body 200. The slide channel 300 further has a length, a depth, an inner intermediate surface, and a pair of inner lateral surfaces, with the length of the slide channel 300 being greater than at least half of the length of the body 200, the depth of the slide channel being sufficient to accommodate at least a portion of the slide 110, the inner intermediate surface of the slide channel 300 being substantially planar and oriented substantially parallel to the top surface 210 of the body 200, the pair of inner lateral surfaces of the slide channel 300 being spaced apart from each other and being oriented substantially parallel to each other and substantially perpendicular to the inner intermediate surface of the slide channel 300, and with the slide channel 300 being open opposite its inner intermediate surface and at its first end 310.

In the preferred embodiments the barrel channel 400 is formed into the bottom surface 220 of the body 200 but is not in communication with the top surface 210 of the body 200. In alternative embodiments the barrel channel 400 may be in partial communication with the top surface 210. The barrel channel 400 is oriented collinearly with the slide channel 300 and has a first end 410, a second end 420, and a width. The first end 410 of the barrel channel 400 is in communication with the front face 250 of the body 200 and the width of the barrel channel 400 is slightly greater than the width 173 of the barrel 170 but less than the width of the slide channel 300. The second end 420 of the barrel channel 400 is in communication with the second end 320 of the slide channel 300. See FIG. 2. The barrel channel 400 is configured to accommodate at least a portion of the barrel 170 within it.

In the most preferred embodiments the barrel channel 400 extends along the length of the body 200 and is oriented substantially parallel with the longitudinal axis of the body 200. The barrel channel 400 further has a length, a depth, an inner intermediate surface, and a pair of inner lateral surfaces, with the length of the barrel channel 400 being less than the length of the slide channel 300, the depth of the barrel channel 400 being substantially the same as the depth of the slide channel 300, the inner intermediate surface of the barrel channel 400 being substantially planar and oriented substantially parallel to the top surface 210 of the body 200, the pair of inner lateral surfaces of the barrel channel 400 being spaced apart from each other and being oriented substantially parallel to each other and substantially perpendicular to the inner intermediate surface of the barrel channel 400, the inner intermediate surface of the barrel channel 400 being substantially coplanar with the inner intermediate surface of the slide channel 300, and with the barrel channel 400 being open opposite its inner intermediate surface and at its first end 410.

The slide stop 500 is formed at the junction of the second ends 320, 420 of the slide channel 300 and the barrel channel 400. See FIGS. 2 and 4C. In the preferred embodiments the slide stop 500 presents a surface oriented substantially perpendicular to the longitudinal axis of the body 200, whereby the surface of the slide stop 500 provides a barrier against which the front portion 112 of the slide 110 is placed, preventing the slide 110 from entering into the barrel channel 170. In alternate embodiments the slide stop 500 presents a surface which is at one or more angles to the longitudinal axis of the body 200, with the degree of the angle(s) being such that the surface of the slide stop 500 continues to provide a barrier against which the front portion 112 of the slide 110 is placed. The slide stop 500 is the surface which is pushed against the slide 110 in order to move the slide 110 in a rearward direction.

The front sight cutout 600 has a length, a width, and a depth, with the length, width, and depth of the front sight cutout 600 being suitably configured to accommodate the front sight 120 of the pistol 100 within the front sight cutout 600. In the preferred embodiments the length of the front sight cutout 600 is slightly greater than the length 121 of the front sight 120, the width of the front sight cutout 600 is slightly greater than the width 123 of the front sight 120, and the depth of the front sight cutout 600 is slightly greater than the height 127 of the front sight 120. The front sight cutout 600 is formed within portions of the intermediate surface of the slide channel 300 and the intermediate surface of the barrel channel 400, with the front sight cutout 600 being located proximate to the second ends 320, 420 of the slide channel 300 and the barrel channel 400. The front sight cutout 600 extends substantially parallel with the longitudinal axis of the body 200. The front sight cutout 600 serves the purpose of protecting the front sight 120 of the pistol 100 when the device 1 is being used, so that minimal pressure, if any, is exerted against the front sight 120 by the device 1.

The rear sight cutout 700 has a length, a width, and a depth, with the length, width, and depth of the rear sight cutout 700 being suitably configured to accommodate the rear sight 130 of the pistol 100 within the rear sight cutout 700. In the preferred embodiments the length of the rear sight cutout 700 is slightly greater than the length 131 of the rear sight 130, the width of the rear sight cutout 700 is slightly greater than the width 133 of the rear sight 130, and the depth of the rear sight cutout 700 is slightly greater than the height 137 of the rear sight. The rear sight cutout 700 is formed within a portion of the intermediate surface of the slide channel 300 and is located proximate to the first end 310 of the slide channel 300. The rear sight cutout 700 extends substantially parallel to the longitudinal axis of the body 200. The rear sight cutout 700 serves the purpose of protecting the rear sight 130 of the pistol 100 when the device 1 is being used, so that minimal pressure, if any, is exerted against the rear sight 130 by the device 1.

In configurations using an ejection port cutout 800, the ejection port cutout 800 has a depth greater than the diameter of an ammunition cartridge that is capable of being fired by the pistol 100. The ejection port cutout 800 extends into a portion of the intermediate surface of the slide channel 300 and extends substantially parallel with the longitudinal axis of the body 200. This allows any ammunition cartridge (including spent cartridges, stuck cartridges, and live cartridges) currently chambered in the pistol 100 to be ejected from the pistol 100 when the slide 110 is racked using the device 1.

In configurations using an extractor cutout 900, the extractor cutout 900 has a length, a width, and a depth, with the length, width, and depth of the extractor cutout 900 being sufficient to allow the extractor 180 to move laterally within the extractor cutout 900. The extractor cutout 900 extends into a portion of the intermediate surface of the slide channel 300 and extends substantially parallel with the longitudinal axis of the body 200. This allows any ammunition cartridge currently chambered in the pistol 100 to be ejected from the pistol 100 when the slide 110 is racked using the device 1.

In preferred embodiments, the device 1 further comprises a hand stop 212. See FIGS. 3, 4A, 4B, 4C, and 6A. The hand stop 212 extends upward from the top surface 210 of the body 200, presenting a surface against which the user may place a portion of the hand gripping the device 1. In the most preferred embodiments the hand stop 212 is substantially planar. It is located at a point between the front face 250 and the rear face 260 of the body 200, with the hand stop 212 located closer to the rear face 260 than to the front face 250. The hand stop 212 is oriented substantially perpendicular to the top surface 210 of the body 200, substantially perpendicular to the first sidewall 230 and to the second sidewall 240 of the body 200, and substantially parallel to the front face 250 and the rear face 260 of the body 200. In alternative embodiments the hand stop 212 may be angled somewhat. It may be substantially rectangular, or semi-circular, or any other suitable shape. The hand stop 212 serves the dual purpose of providing another surface for the use to push against when using the device 1, as well as providing a barrier to prevent the user's hand from sliding off the body 200 of the device 1 during use.

In preferred embodiments, the device 1 further comprises a first finger groove 232. See FIGS. 3 and 4A. The first finger groove 232 is formed into the first sidewall 230 of the body 200. The first finger groove 232 is configured to accommodate one or more fingers or thumb of a human hand when the hand grips the device 1. Preferably, the first finger groove 232 has a length less than the length of the body 200, a width less than the distance between the top surface 210 and bottom surface 220 of the body 200, and a depth less than the thickness of the first sidewall 230. The first finger groove 232 may be substantially rectangular, or it may have rounded sides, or any other suitable configuration. The device 1 may also have a second finger groove 242. See FIGS. 2 and 6A. The second finger groove 242 is formed into the second sidewall 240 of the body 200. The second finger groove 242 is configured to accommodate one or more fingers or thumb of a human hand when the hand grips the device 1. When two finger grooves 232,242 are used, the device 1 has an ambidextrous configuration, being equally grippable by the right or left hand. Preferably, the second finger groove 242 has a length less than the length of the body, a width less than the distance between the top surface 210 and bottom surface 220 of the body 200, and a depth less than the thickness of the second sidewall 240. The second finger groove 242 may be substantially rectangular, or it may have rounded sides, or any other suitable configuration. The second finger groove 242 may be configured and dimensioned substantially identical to the first finger groove 232, or it may be configured and/or dimensioned differently.

In preferred embodiments, the device 1 further comprises a directional indicator 214. See FIG. 3. The directional indicator 214 is formed into the top surface 210 of the body 200. The directional indicator 214 indicates the direction of the line of fire of the pistol 100, also known as the "down range" direction. In the most preferred embodiments the directional indicator 214 is in the shape of an arrow pointing in the direction of the line of fire of the pistol 100. Other shapes or even text can be used as well.

Figure 6A:
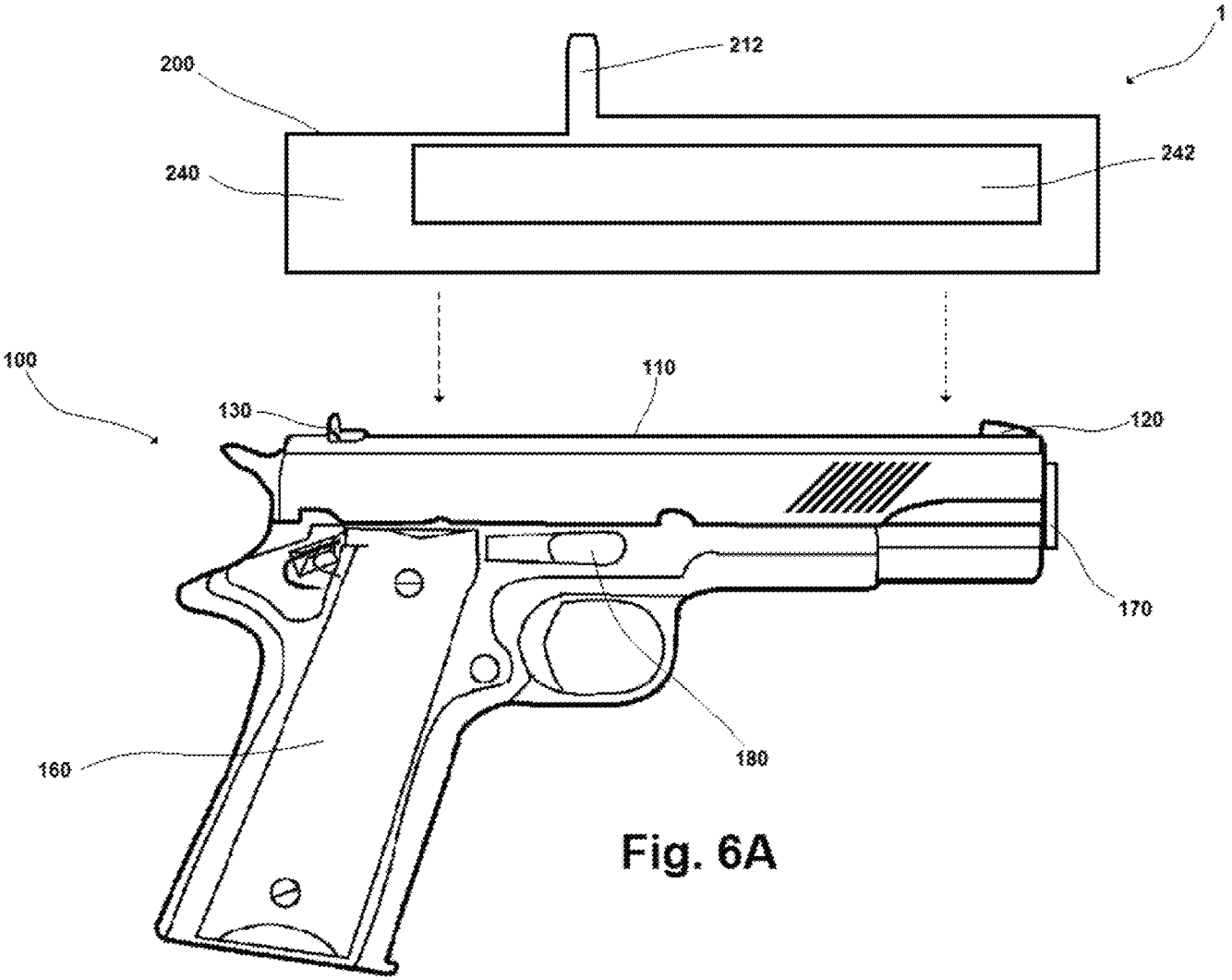
FIG. 6A is a plan side view of the embodiment of the device shown in FIG. 1 and a plan side view of the pistol shown in FIG. 5A, with arrows indicating how the device is initially positioned above the pistol and then moved downward toward the pistol.
Figure 6B:
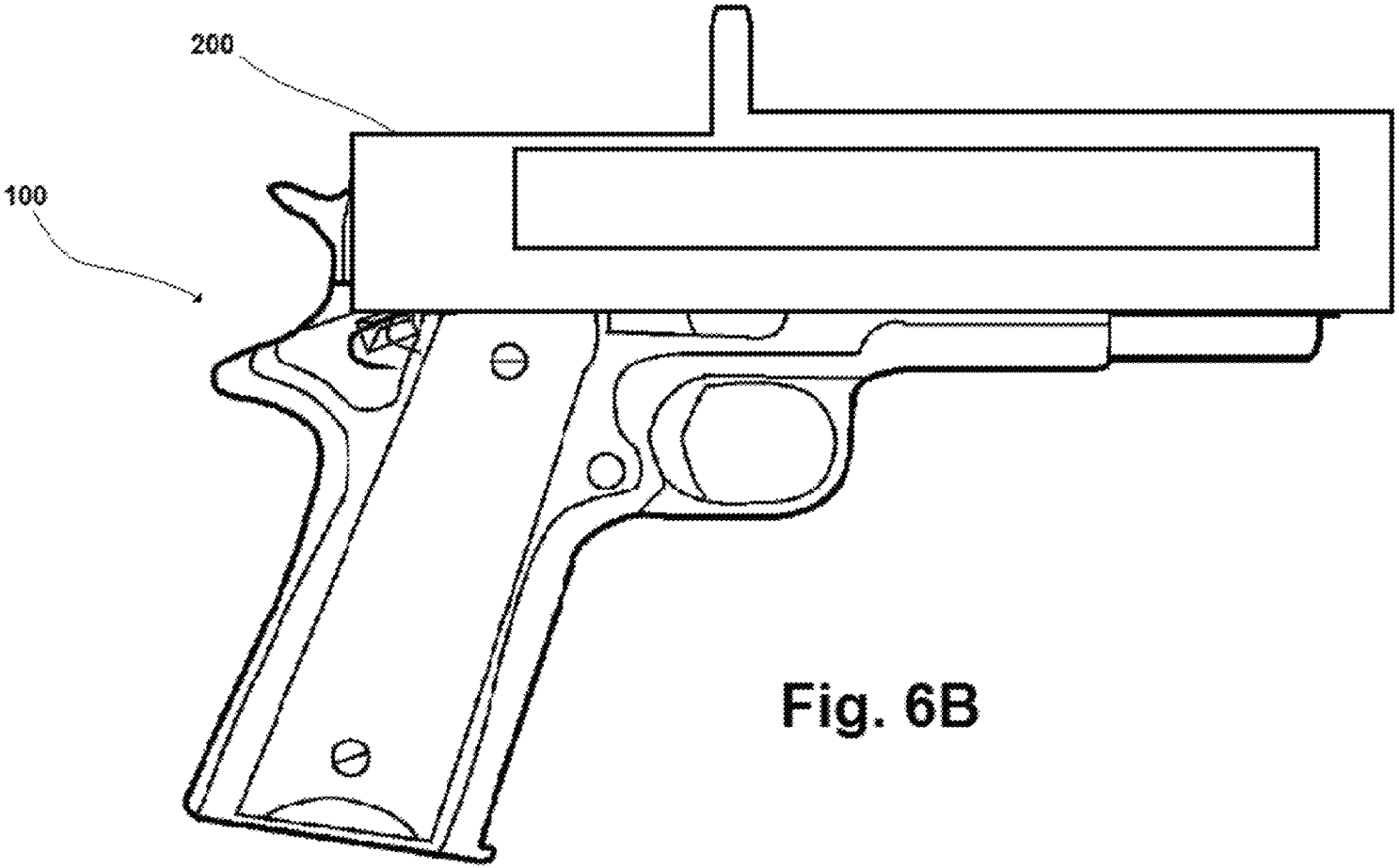
FIG. 6B is a plan side view of the embodiment of the device shown in FIG. 1 and a plan side view of the pistol shown in FIG. 5A, showing the device positioned onto the pistol.
Figure 6C:
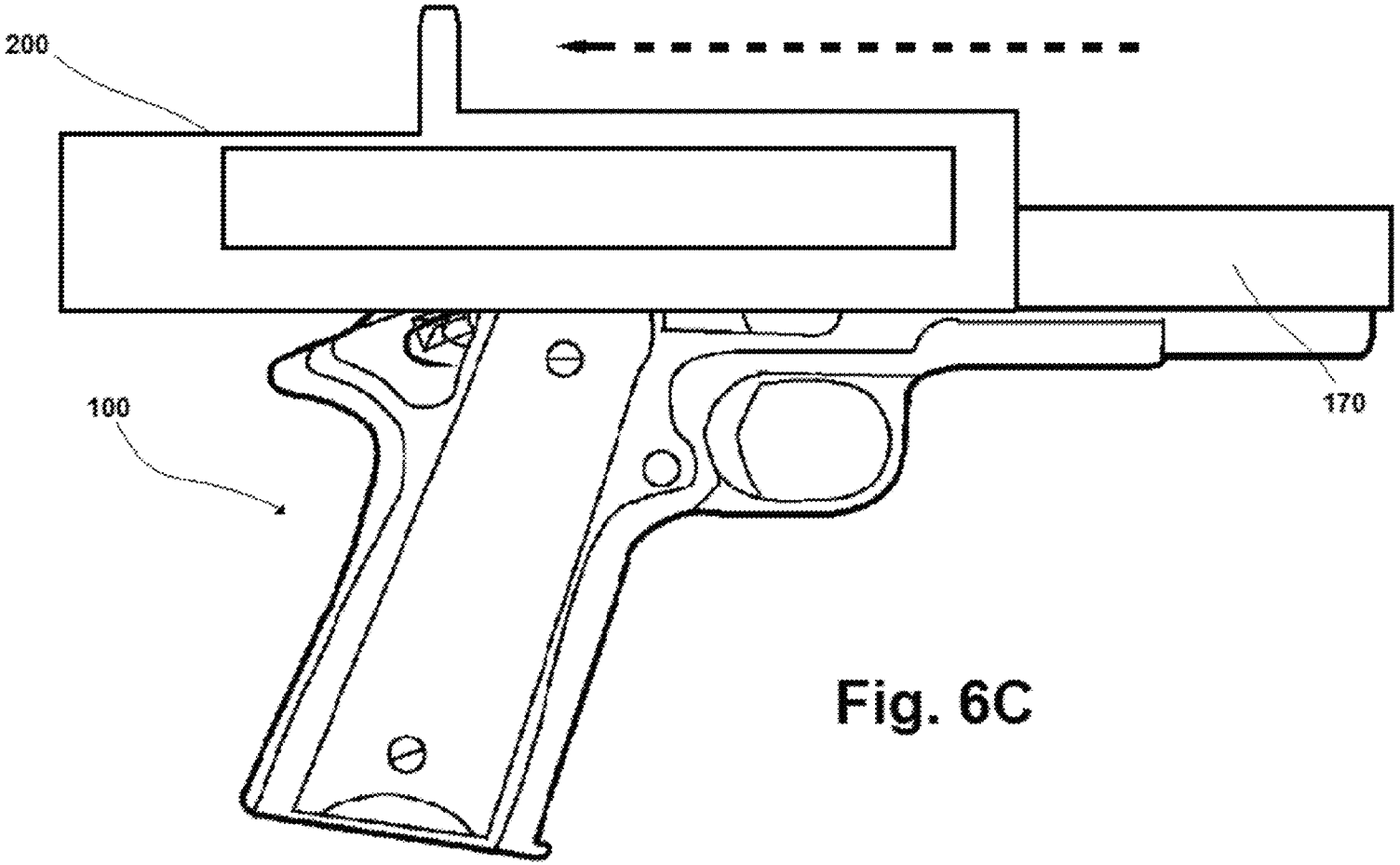
FIG. 6C is a plan side view of the embodiment of the device shown in FIG. 1 and a plan side view of the pistol shown in FIG. 5A, showing the device positioned onto the pistol, with an arrow indicating how the device is moved rearward relative to the pistol frame, moving the slide and exposing the barrel.
Figure 6D:
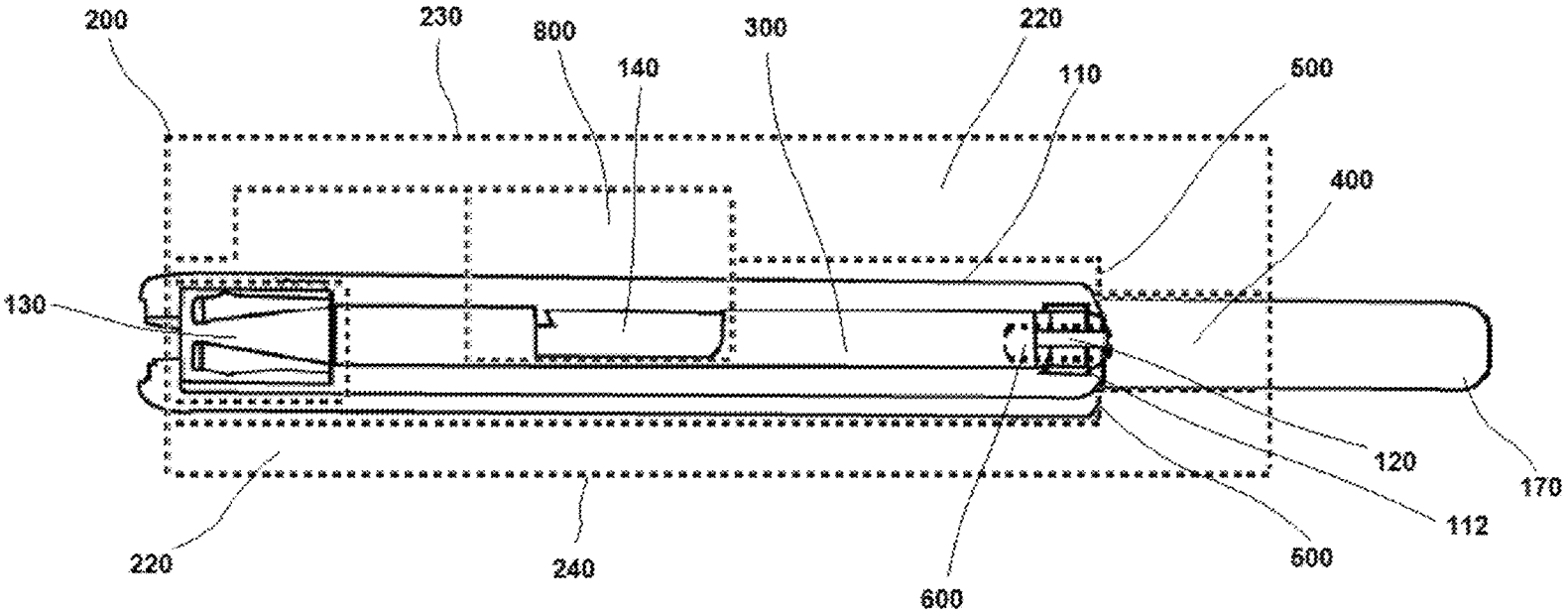
FIG. 6D is a plan top view of the embodiment of the device shown in FIG. 1 and a plan top view of the pistol shown in FIG. 5A, showing the device positioned onto the pistol, having been moved rearward relative to the pistol frame; the device is shown in ghost line to reveal the portions of the device formed into its bottom surface and the top of the pistol.

During use of the device 1, the user grips the hand grip 160 of the pistol 100 with one hand and holds the device 1 in the other hand. The user places the device 1 on top of the slide 110 such that at least a portion of the top surface 114 of the slide 110 extends into the slide channel 300 and is in direct contact with the intermediate surface of the slide channel 300, at least a portion of the barrel 170 extends into the barrel channel 400, at least a portion of the front sight 120 extends into the front sight cutout 600, at least a portion of the rear sight 130 extends into the rear sight cutout 700, at least a portion of the ejection port 140 is substantially aligned with the ejection port cutout 800, and at least a portion of the extractor 180 is substantially aligned with the extractor cutout 900. See FIG. 6B. The user then applies downward pressure to the device 1 against the pistol 100 while moving the device 1 in a rearward direction relative to the frame 150 of the pistol 100. This causes the slide stop 500 of the device 1 to come into contact with the front portion 112 of the slide 110, forcing the slide 110 to move rearward relative to the frame 150. See FIGS. 6C and 6D. Once the slide 110 is moved sufficiently rearward to cause a round to be chambered, the user removes the device 1 from the pistol 100 and sets it aside. The pistol 100 is now ready for use. No portion of the device 1 obscures the line of fire of the pistol 100 during placement of the device 1 onto the pistol 100, use of the device 1 with the pistol 100, or removal of the device 1 from the pistol 100.

What has been described and illustrated herein is a preferred embodiment of the invention along with some it its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

We claim:

1. A device for assisting with the movement of a slide of a pistol, said pistol having said slide, a frame, a hand grip integrated with the frame, a barrel mounted on the frame, a front sight mounted on the slide, a rear sight mounted on the slide, an ejection port integrated with the slide, an extractor, and a line of fire, said slide being moveable relative to the frame in forward and rearward directions, said device comprising a body, said body having a top surface, a bottom surface, a first sidewall, a second sidewall, a front face, a rear face, and a longitudinal axis;

a slide channel formed into the bottom surface of the body, said slide channel having a first end, a second end, and a width, with the first end of the slide channel being in communication with the rear face of the body, and the width of the slide channel being slightly greater than a width of the slide;

a barrel channel formed into the bottom surface of the body, said barrel channel oriented collinearly with the slide channel, said barrel channel having a first end, a second end, and a width, with the first end of the barrel channel being in communication with the front face of the body, the width of the barrel channel being slightly greater than a width of the barrel and less than the width of the slide channel, and the second end of the barrel channel being in communication with the second end of the slide channel;

a slide stop, said slide stop formed at the junction of the second ends of the slide channel and the barrel channel, said slide stop presenting a surface, whereby the surface of the slide stop provides a barrier against which a front portion of the slide is placed, preventing the slide from entering into the barrel channel;

a front sight cutout formed into the bottom surface of the body, said front sight cutout having a length, a width, and a depth, with the length, width, and depth of the front sight cutout being suitably configured to accommodate the front sight within the front sight cutout; and a rear sight cutout formed into the bottom surface of the body, said rear sight cutout having a length, a width, and a depth, with the length, width, and depth of the rear sight cutout being suitably configured to accommodate the rear sight within the rear sight cutout;

wherein the device is configured to be placed on top of the slide such that at least a portion of the slide extends into the slide channel, at least a portion of the barrel extends into the barrel channel, at least a portion of the front sight extends into the front sight cutout, and at least a portion of the rear sight extends into the rear sight cutout, and whereby the device is configured to be used by a user by said user gripping the hand grip of the pistol with one hand, holding the device in another hand and placing the device onto the slide such that at least a portion of the slide extends into the slide channel, at least a portion of the barrel extends into the barrel channel, at least a portion of the front sight extends into the front sight cutout, and at least a portion of the rear sight extends into the rear sight cutout, then said user applying downward pressure to the device against the pistol while moving the device in a rearward direction relative to the frame of the pistol such that the slide stop of the device comes into contact with the front portion of the slide and forces the slide to move rearward relative to the frame, with no portion of the device obscuring the line of fire during placement of the device onto the pistol, use of the device with the pistol, or removal of the device from the pistol.

2. The device of claim 1 further comprising an ejection port cutout formed into the bottom surface of the body, said ejection port cutout having a depth, with the depth of the ejection port cutout being greater than a diameter of an ammunition cartridge that is capable of being used with the pistol; and an extractor cutout formed into the bottom surface of the body, said extractor cutout having a length, a width, and a depth, with the length, width, and depth of the extractor cutout being sufficient to allow the extractor to move laterally within the extractor cutout;

wherein the device is further configured to be placed on top of the slide such that at least a portion of the ejection port is substantially aligned with the ejection port cutout, and at least a portion of the extractor is substantially aligned with the extractor cutout, whereby the device is further configured to be used by a user by said user placing the device onto the slide such that at least a portion of the ejection port is substantially aligned with the ejection port cutout, and at least a portion of the extractor is substantially aligned with the extractor cutout.

3. The device of claim 2 wherein the body is monolithic and is constructed of a substantially rigid material, the body further has a length, the top surface of the body is substantially planar, the first sidewall of the body is substantially planar, the first sidewall of the body is oriented substantially perpendicular to the front and rear faces of the body, the second sidewall of the body is substantially planar, the second sidewall of the body is oriented substantially perpendicular to the front and rear faces of the body, the second sidewall is spaced apart from the first sidewall, the second sidewall is oriented substantially parallel to the first sidewall, the front face of the body is substantially planar, and the rear face of the body is substantially planar;

the slide channel extends along the length of the body and is oriented substantially parallel with a longitudinal axis of the body, the slide channel further has a length, a depth, an inner intermediate surface, and a pair of inner lateral surfaces, with the length of the slide channel being greater than at least half of the length of the body, the depth of the slide channel being sufficient to accommodate at least a portion of the slide, the inner intermediate surface of the slide channel being substantially planar and oriented substantially parallel to the top surface of the body, the pair of inner lateral surfaces of the slide channel being spaced apart from each other and being oriented substantially parallel to each other and substantially perpendicular to the inner intermediate surface of the slide channel, and with the slide channel being open opposite its inner intermediate surface and at its first end;

the barrel channel extends along the length of the body and oriented substantially parallel with the longitudinal axis of the body, the barrel channel further has a length, a depth, an inner intermediate surface, and a pair of inner lateral surfaces, with the length of the barrel channel being less than the length of the slide channel, the depth of the barrel channel being substantially the same as the depth of the slide channel, the inner intermediate surface of the barrel channel being substantially planar and oriented substantially parallel to the top surface of the body, the pair of inner lateral surfaces of the barrel channel being spaced apart from each other and being oriented substantially parallel to each other and substantially perpendicular to the inner intermediate surface of the barrel channel, the inner intermediate surface of the barrel channel being substantially coplanar with the inner intermediate surface of the slide channel, and with the barrel channel being open opposite its inner intermediate surface and at its first end;

the surface presented by the slide stop is oriented substantially perpendicular to the longitudinal axis of the body;

the front sight cutout is formed within portions of the intermediate surface of the slide channel and the intermediate surface of the barrel channel proximate to the seconds ends of the slide channel and the barrel channel, and the front sight cutout extends substantially parallel with the longitudinal axis of the body;

the rear sight cutout is formed within a portion of the intermediate surface of the slide channel proximate to the first end of the slide channel, and the rear sight cutout extends substantially parallel to the longitudinal axis of the body;

the ejection port cutout extends into a portion of the intermediate surface of the slide channel and extends substantially parallel with the longitudinal axis of the body;

the extractor cutout extends into a portion of the intermediate surface of the slide channel and extends substantially parallel with the longitudinal axis of the body;

wherein the device is configured to be placed on top of the slide such that at least a portion of a top surface of the slide is in direct contact with the intermediate surface of the slide channel.

4. The device of claim 1 wherein the length of the front sight cutout being slightly greater than a length of the front sight, the width of the front sight cutout being slightly greater than a width of the front sight, and the depth of the front sight cutout being slightly greater than a height of the front sight; and the length of the rear sight cutout being slightly greater than a length of the rear sight, the width of the rear sight cutout being slightly greater than a width of the rear sight, and the depth of the rear sight cutout being slightly greater than a height of the rear sight.

5. The device of claim 1 further comprising a hand stop, said hand stop extending upward from the top surface of the body.

6. The device of claim 5 wherein the hand stop is substantially planar, is located at a point between the front face and the rear face of the body, with the hand stop located closer to the rear face than to the front face, the hand stop is oriented substantially perpendicular to the top surface of the body, substantially perpendicular to the first sidewall and to the second sidewall of the body, and substantially parallel to the front face and the rear face of the body.

7. The device of claim 1 further comprising a first finger groove formed into the first sidewall of the body, wherein said first finger groove is configured to accommodate one or more fingers or thumb of a human hand when the hand grips the device.

8. The device of claim 7 wherein the first finger groove has a length less than a length of the body, a width less than a distance between the top surface and bottom surface of the body, and a depth less than a thickness of the first sidewall.

9. The device of claim 7 further comprising a second finger groove formed into the second sidewall of the body, wherein said second finger groove is configured to accommodate one or more fingers or thumb of a human hand when the hand grips the device.

10. The device of claim 9 wherein the second finger groove has a length less than a length of the body, a width less than a distance between the top surface and bottom surface of the body, and a depth less than a thickness of the second sidewall.

11. The device of claim 9 wherein the second finger groove is dimensioned substantially identical to the first finger groove.

12. The device of claim 1 further comprising a directional indicator formed into the top surface of the body, said directional indicator indicating the direction of the line of fire of the pistol.

13. The device of claim 12 wherein the directional indicator is in the shape of an arrow pointing in the direction of the line of fire of the pistol.

14. The device of claim 1 wherein the body is constructed of a high impact plastic material.

15. The device of claim 1 wherein the body is formed by injection molding.

16. The device of claim 2 wherein the body further comprises a hand stop, said hand extending upward from the top surface of the body;

a first finger groove formed into the first sidewall of the body, wherein said first finger groove is configured to accommodate one or more fingers or thumb of a human hand when the hand grips the device;

a second finger groove formed into the second sidewall of the body, wherein said second finger groove is configured to accommodate one or more fingers or thumb of a human hand when the hand grips the device; and a directional indicator formed into the top surface of the body, said directional indicator indicating the direction of the line of fire of the pistol.

17. The device of claim 16 wherein the hand stop is substantially planar, is located at a point between the front face and the rear face of the body, with the hand stop located closer to the rear face than to the front face, said hand stop being oriented substantially perpendicular to the top surface of the body, substantially perpendicular to the first sidewall and to the second sidewall of the body, and substantially parallel to the front face and the rear face of the body;

the first finger groove has a length less than the length of the body, a width less than a distance between the top surface and bottom surface of the body, and a depth less than a thickness of the first sidewall;

the second finger groove has a length less than the length of the body, a width less than a distance between the top surface and bottom surface of the body, and a depth less than the thickness of the first sidewall, with the second finger groove being dimensioned substantially identical to the first finger groove; and the directional indicator is in the shape of an arrow pointing in the direction of the line of fire of the pistol.

18. The device of claim 17 wherein the body is monolithic and is constructed of a substantially rigid material, the body further has a length, the top surface of the body is substantially planar, the first sidewall of the body is substantially planar, the first sidewall of the body is oriented substantially perpendicular to the front and rear faces of the body, the second sidewall of the body is substantially planar, the second sidewall of the body is oriented substantially perpendicular to the front and rear faces of the body, the second sidewall is spaced apart from the first sidewall, the second sidewall is oriented substantially parallel to the first sidewall, the front face of the body is substantially planar, and the rear face of the body is substantially planar;

the slide channel extends along the length of the body and is oriented substantially parallel with a longitudinal axis of the body, the slide channel further has a length, a depth, an inner intermediate surface, and a pair of inner lateral surfaces, with the length of the slide channel being greater than at least half of the length of the body, the depth of the slide channel being sufficient to accommodate at least a portion of the slide, the inner intermediate surface of the slide channel being substantially planar and oriented substantially parallel to the top surface of the body, the pair of inner lateral surfaces of the slide channel being spaced apart from each other and being oriented substantially parallel to each other and substantially perpendicular to the inner intermediate surface of the slide channel, and with the slide channel being open opposite its inner intermediate surface and at its first end;

the barrel channel extends along the length of the body and oriented substantially parallel with the longitudinal axis of the body, the barrel channel further has a length, a depth, an inner intermediate surface, and a pair of inner lateral surfaces, with the length of the barrel channel being less than the length of the slide channel, the depth of the barrel channel being substantially the same as the depth of the slide channel, the inner intermediate surface of the barrel channel being substantially planar and oriented substantially parallel to the top surface of the body, the pair of inner lateral surfaces of the barrel channel being spaced apart from each other and being oriented substantially parallel to each other and substantially perpendicular to the inner intermediate surface of the barrel channel, the inner intermediate surface of the barrel channel being substantially coplanar with the inner intermediate surface of the slide channel, and with the barrel channel being open opposite its inner intermediate surface and at its first end;

the surface presented by the slide stop is oriented substantially perpendicular to the longitudinal axis of the body;

the front sight cutout is formed within portions of the intermediate surface of the slide channel and the intermediate surface of the barrel channel proximate to the seconds ends of the slide channel and the barrel channel, and the front sight cutout extends substantially parallel with the longitudinal axis of the body;

the rear sight cutout is formed within a portion of the intermediate surface of the slide channel proximate to the first end of the slide channel, and the rear sight cutout extends substantially parallel to the longitudinal axis of the body;

the ejection port cutout extends into a portion of the intermediate surface of the slide channel and extends substantially parallel with the longitudinal axis of the body;

the extractor cutout extends into a portion of the intermediate surface of the slide channel and extends substantially parallel with the longitudinal axis of the body;

wherein the device is configured to be placed on top of the slide such that at least a portion of a top surface of the slide is in direct contact with the intermediate surface of the slide channel.

19. The device of claim 18 wherein the length of the front sight cutout being slightly greater than a length of the front sight, the width of the front sight cutout being slightly greater than a width of the front sight, and the depth of the front sight cutout being slightly greater than a height of the front sight; and the length of the rear sight cutout being slightly greater than a length of the rear sight, the width of the rear sight cutout being slightly greater than a width of the rear sight, and the depth of the rear sight cutout being slightly greater than a height of the rear sight.

20. The device of claim 19 wherein the body is constructed of a high impact plastic material.

* * * * *